United States Patent [19]

Mueller et al.

[11] B 3,981,385

[45] Sept. 21, 1976

[54] TYPING MACHINE KEY ACTION

[75] Inventors: Hans W. Mueller; Richard E. Shattuck, both of Cortland, N.Y.

[73] Assignee: SCM Corporation, New York, N.Y.

[22] Filed: Aug. 28, 1974

[21] Appl. No.: 501,122

[44] Published under the second Trial Voluntary Protest Program on February 17, 1976 as document No. B 501,122.

[52] U.S. Cl. ..... 197/17

[51] Int. Cl.[2] ..... B41J 23/06

[58] Field of Search ..... 197/17, 33

[56] References Cited

UNITED STATES PATENTS

| | | | |
|---|---|---|---|
| 3,400,799 | 9/1968 | Stuiber | 197/17 |
| 3,419,123 | 12/1968 | Salzberger et al. | 197/17 |
| 3,537,562 | 11/1970 | Caudill et al. | 197/17 |
| 3,578,128 | 5/1971 | Frechette et al. | 197/17 |
| 3,623,587 | 11/1971 | Link | 197/17 |
| 3,633,723 | 1/1972 | Kosters | 197/17 |
| 3,638,775 | 2/1972 | Hishida et al. | 197/17 |
| 3,706,366 | 12/1972 | Hishida et al. | 197/17 |
| 3,738,470 | 6/1973 | Osaka | 197/17 |
| 3,838,762 | 10/1974 | Madison | 197/17 |

*Primary Examiner*—Wm. H. Grieb

*Attorney, Agent, or Firm*—Kenneth W. Greb; Milton M. Wolson

[57] ABSTRACT

An interposer in a typing machine key action is supported by an arcuate spring and a shelf. When a key lever bears against the arcuate spring to release the interposer from the shelf, the arcuate spring snaps the interposer against a pawl that engages a power roll to initiate a typing operation. Potential energy is restored to the arcuate spring as the key lever lifts the interposer back to rest position. The arcuate spring serves as a support and frictionless pivot for the interposer and biases the interposer against the shelf while providing energy to impel the interposer against the pawl.

12 Claims, 8 Drawing Figures

TYPING MACHINE KEY ACTION

BACKGROUND OF THE INVENTION

1. Field of the Invention

This invention relates to key actions for power driven typing machines and more particularly to an arcuate spring for an interposer in a key action.

2. Description of the Prior Art

Prior typing machine key actions such as one disclosed in a U.S. Pat. No. 3,419,123 to Salzberger et al still fall short of the optimum requirements for a key action. They are relatively expensive to manufacture, their parts are subject to a large amount of friction and wear because of their design, and they occupy a large amount of vertical space. Their designs are predicated on the use of pin-supported interposers activated by independent springs which inherently introduce friction as well as additional components into the overall structure.

SUMMARY OF THE INVENTION

It is, therefore, an object of the invention to provide a key action that is less expensive to manufacture than prior key actions and has less parts.

Another object of the invention is to minimize friction and wear in the key action.

Another object of the invention is to provide a key action that occupies very little vertical space thus enabling a typing machine to have an aesthetically pleasing low silhouette.

Another object of the invention is to provide a key action that is extremely rapid in response thus permitting very high typing speeds.

A still further object of the invention is to provide a key action that operates reliably over long periods and requires minimal maintenance.

In order to accomplish the objects of the invention, an interposer in a typing machine key action is supported by an arcuate spring and a shelf. When a key lever bears against the arcuate spring to release the interposer from the shelf, the arcuate spring snaps the interposer against a pawl that engages a power roll to initiate a typing operation. Potential energy is restored to the arcuate spring as the key lever lifts the interposer back to rest position. Since the key lever bears against the arcuate spring instead of bearing against the interposer, there is very little friction and wear between the interposer and the shelf. In addition, the arcuate spring acts as a frictionless pivot for the interposer. The typing machine can have an aesthetically pleasing low silhouette because of the horzontal orientation and action of the interposer. Since the arcuate spring snaps the interposer against the pawl, the pawl quickly engages the power roll without chattering against teeth on the power roll.

Other objects and a fuller understanding of the invention can be had by referring to the description of the preferred embodiments and the claims, taken in conjunction with the accompanying drawing as hereinafter described.

BRIEF DESCRIPTION OF THE DRAWING

FIG. 2 is a left side elevation view of the invention shown in FIG. 1 with the key action in rest position;

FIG. 8 is a perspective view of another embodiment of the invention.

DESCRIPTION OF THE PREFERRED EMBODIMENTS

Figure 1:
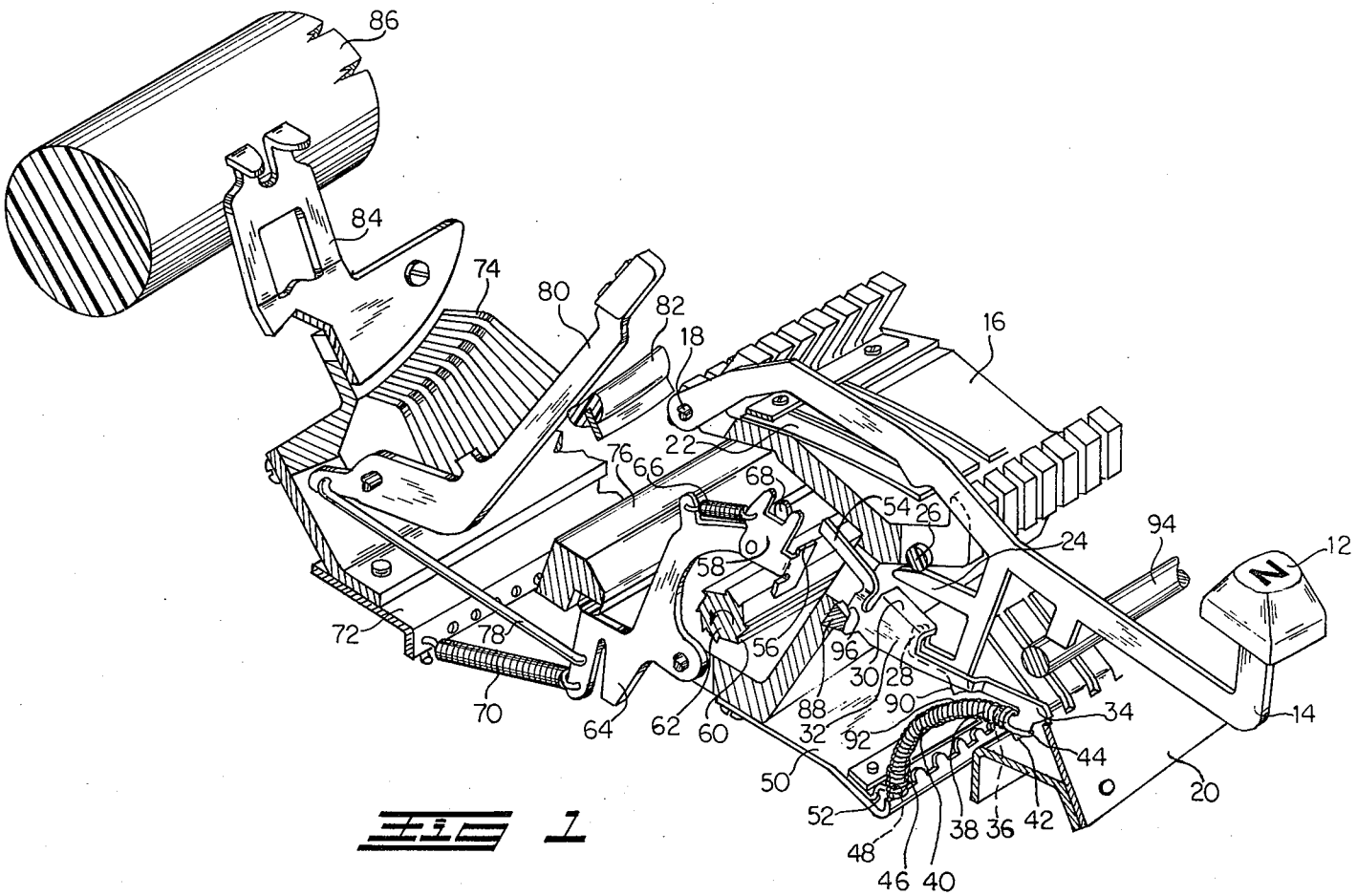
FIG. 1 is a perspective view of an embodiment of the invention.

FIG. 1 illustrates an embodiment of the invention in conjunction with those portions of a typing machine that coact with and are relevant to the invention. The term "typing machine" as used herein applies to any one of many different kinds of machines such as typewriters, ball printers, printers for computers, teletypewriters, adding machines, calculators, cash registers, and the like.

As shown in FIG. 1, the key action includes a key 12 mounted on a key lever 14 that is pivotally connected to a key lever support comb 16 by a pivot pin 18 and vertically guided by a key lever guide comb 20. A cantilever flat spring 22 mounted on the key lever support comb 16 biases an arm 24 on the key lever 14 upward against a stop 26 on the key lever support comb 16. The stop 26 is composed of vinyl plastic or other suitable material.

A nose 28 on the key lever 14 engages a flange 30 on an interposer 32, while the front end 34 of the interposer 32 has a prong 36 that extends into the top end 38 of an arcuate coil spring 40, arcuate in the sense that the arcuate coil spring 40 is arcuately supported. The arcuate coil spring 40 is straight when disassembled. The interposer 32 is held on the arcuate coil spring 40 by a knuckle 42 that engages a hook 44 on the arcuate coil spring 40. The bottom end 46 of the arcuate coil spring 40 is impaled on a stationary portion of the typing machine represented by a spike 48 on a plate 50 that is connected to the key lever support comb 16. A lip 52 mounted on the plate 50 engages the arcuate coil spring 40 to hold the arcuate coil spring 40 on the spike 48.

The rear end 54 of the interposer 32 is poised above a top surface 56 of a pawl 58 that is positioned to engage one of multiple teeth 60 on a power roll 62. The pawl 58 is pivotally connected to an actuator 64 that in turn is pivotally connected to the key lever support comb 16. A coil tension spring 66 connected between the pawl 58 and the actuator 64 biases the pawl 58 counterclockwise against a bent ear 68 on the actuator 64, while a coil tension spring 70 connected between the actuator 64 and a bracket 72 on a typebar segment 74 biases the actuator 64 against an actuator stop bar 76. A link 78 pivotally connects the actuator 64 to a typebar 80 that in turn is pivotally connected to the typebar segment 74 and is normally disposed against a typebar rest 82. When actuated, the typebar 80 (guided by a typebar guide 84 mounted on the typebar segment 74) strikes a platen 86. Although the key action has been described in the singular, a complete typing machine could have as many as 44 or more key actions. The key lever support comb 16, key lever guide comb 20, and typebar segment 74 help guide and prevent lateral movement of the key action.

FIG. 2 to 6 represent successive steps during one typing operation. Other typing machine operations are also possible using the invention such as spacing, case shifting, repeat typing, and so forth. For completeness, FIG. 2 shows the key action in rest position as in FIG. 1.

Figure 3:
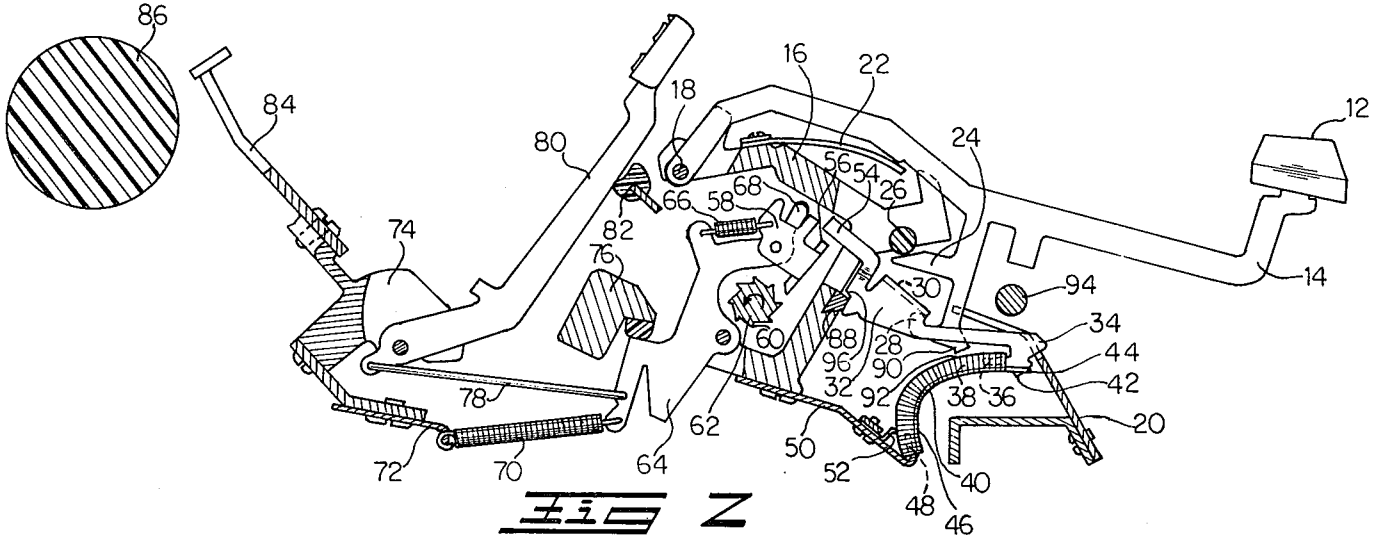
FIG. 3 is a view similar to that of FIG. 2 just before tripping of the key action with the key partially depressed.

As shown in FIG. 3, initial depression of the key lever 14 to a position just prior to tripping of the interposer 32 causes the nose 28 on the key lever 14 to drop away from the flange 30 on the interposer 32 so that the interposer 32 is supported solely by a shelf 88 and the arcuate coil spring 40. A heel 90 on the key lever 14 contacts an intermediate portion 92 of the arcuate coil spring 40.

Figure 4:
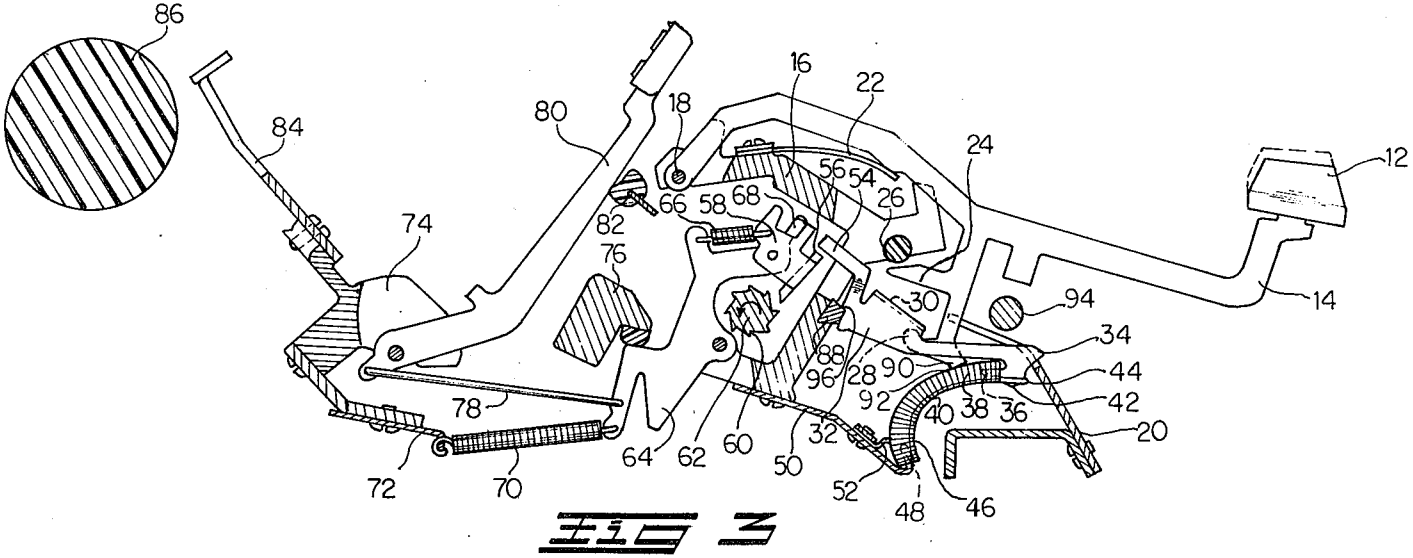
FIG. 4 is a view similar to that of FIG 3 just after tripping of the key action.
Figure 4:
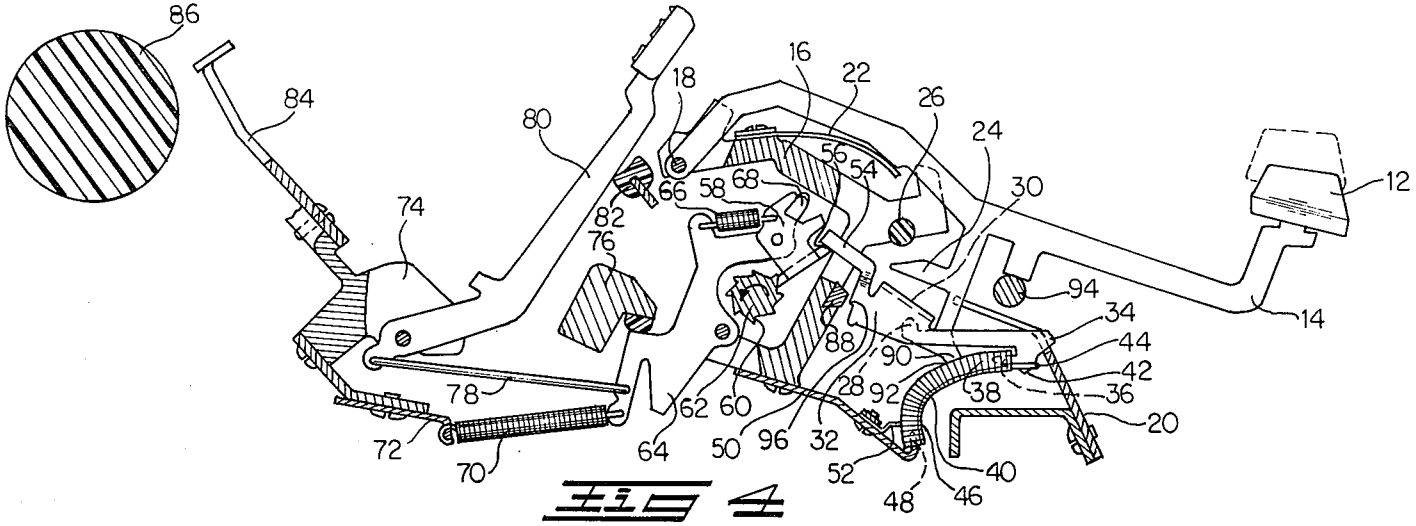

Just after tripping of the interposer 32, the key action is oriented as shown in FIG. 4. The key lever 14 is depressed as far as possible with a space bar shaft 94 preventing further depression. The heel 90 on the key lever 14 has pushed the arcuate coil spring 40 forward (to the right) to pull the interposer 32 so that a ledge 96 on the interposer 32 has fallen off the shelf 88 on the key lever support comb 16. The top end 38 of the arcuate coil spring 40 has pivoted about the heel 90 on the key lever 14 and snapped the rear end 54 of the interposer 32 against the pawl 58 and the pawl 58 clockwise against the bent ear 68 on the actuator 64 and against the power roll 62. Since the nose 28 on the key lever 14 is below the flange 30 on the interposer 32, no part of the key lever 14 contacts the interposer 32. Therefore, no irritating jolt can be transmitted back to the key 12 on the key lever 14. The action of the heel 90 against the arcuate coil spring 40 instead of against the interposer 32 sharply reduces friction between the interposer 32 and the shelf 88 as the interposer 32 is tripped.

Figure 5:
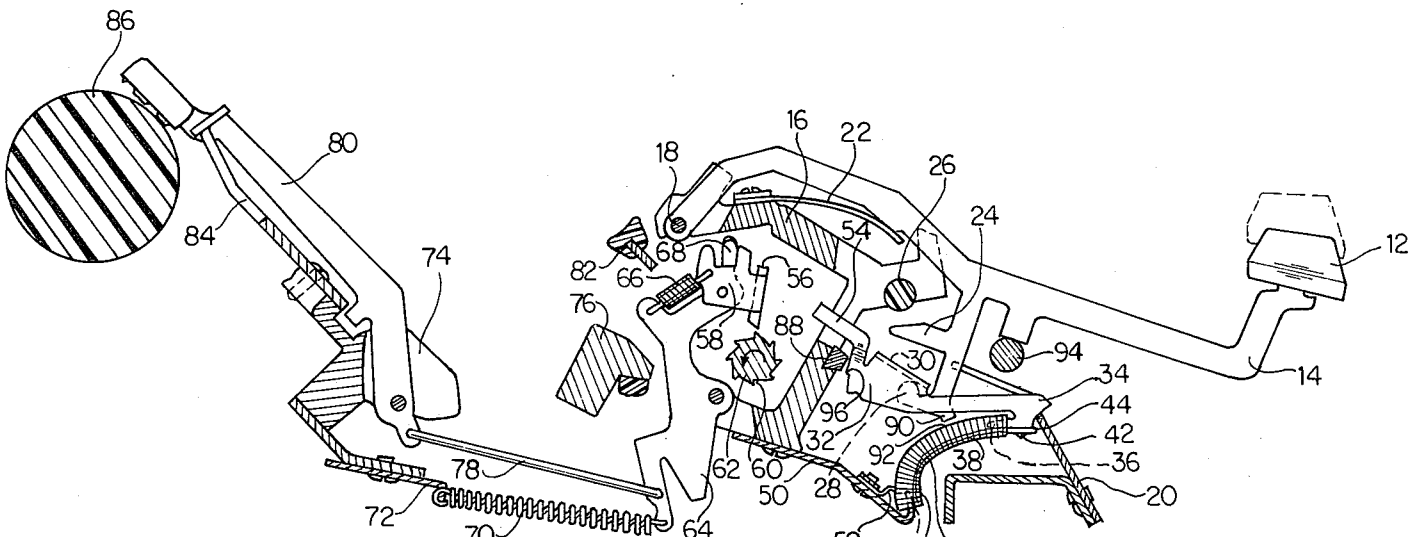
FIG. 5 is a view similar to that of FIG. 4 with the typebar actuated by the key action.
Figure 5:
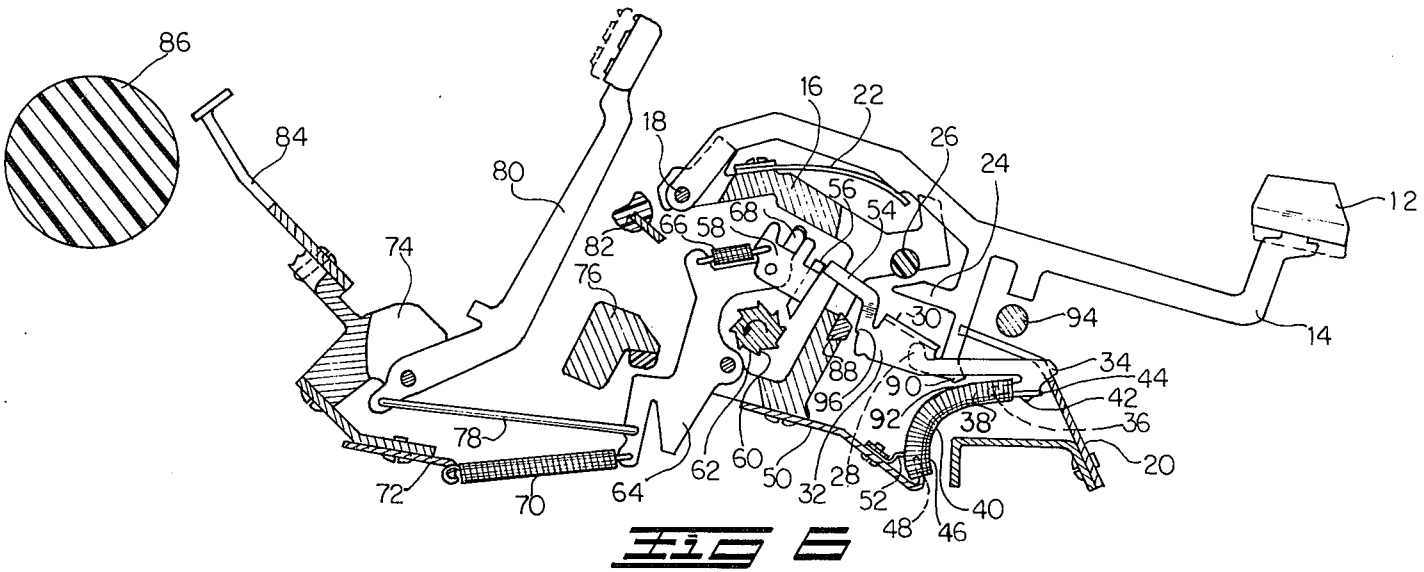

With the key lever 14 still depressed as far as possible, one of the teeth 60 on the power roll 62 engages the pawl 58 to pivot the actuator 64 and (through the link 78) the typebar 80 counterclockwise to perform a typing operation as shown in FIG. 5. The interposer 32 is now supported by the nose 28 on the key lever 14.

Figure 6:
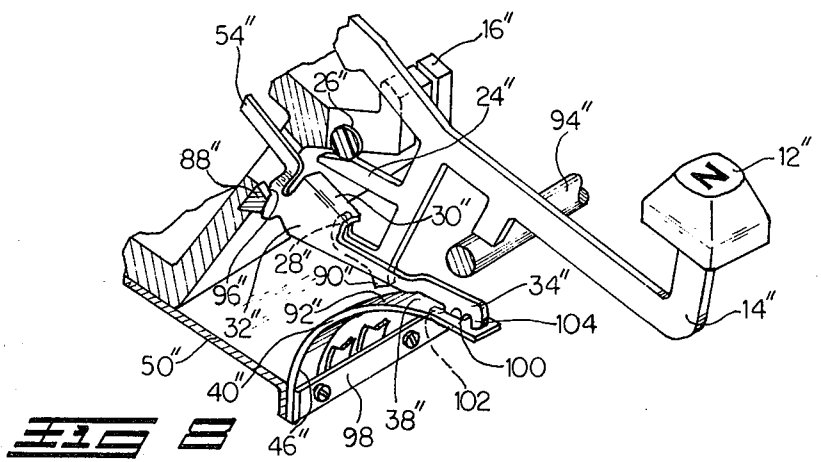
FIG. 6 is a view similar to that of FIG. 5 with the key action partially restored toward the rest position.

Upon release of the key 12, the key action begins to return to the rest position as shown in FIG. 6. As the cantilever flat spring 22 lifts the key lever 14, the nose 28 on the key lever 14 lifts the interposer 32 to store potential energy in the arcuate coil spring 40 by recocking the arcuate coil spring 40. A repeat typing operation is prevented while the key lever 14 is depressed because the rear end 54 of the interposer 32 is below the top surface 56 of the returning pawl 58.

Figure 7:
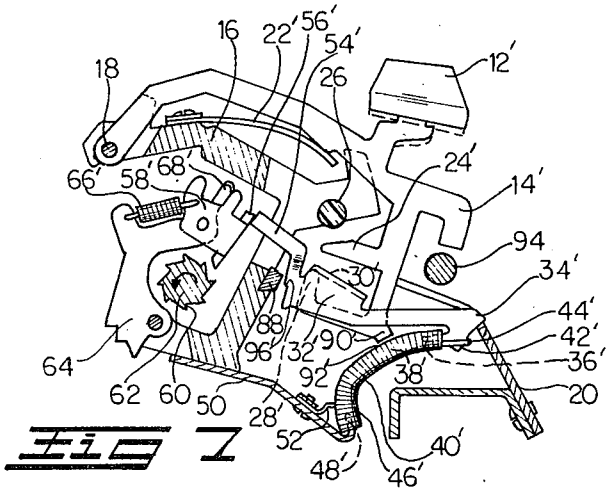
FIG. 7 is a partial view similar to that of FIG. 6, but showing a different key.

Thus far, the key lever 14 that has been described is for a key 12 that is nearest to the operator. FIG. 7 shows a key lever 14′ for a key 12′ that is farthest from the operator. For ease of comparison, the key action is in the same partially restored position as the key action in FIG. 6, and the same reference numerals have been used, but distinguished by primes for the parts that are not common to the two key actions.

In FIG. 7 the only part that is shaped differently is the key lever 14′. In order for the shorter key lever 14′ to trip and restore the interposer 32′ at the same times as the key lever 14 previously described, the heel 90′ on the key lever 14′ is slightly shorter, and the nose 28′ on the key lever 14′ contacts the flange 30′ on the interposer 32′ at a rearward location as opposed to a forward location contacted by the nose 28 previously described. Key levers of intermediate lengths would also have their heels and noses adjusted so that they would trip and restore their interposers at the same times as the key levers 14 and 14′. If the heels and noses were not adjusted, the key actions would operate at different times during depressions and restorations of the key levers thus causing a sense of irregular operation.

Another embodiment of the invention is shown in FIG. 8. This embodiment of the invention is the same as the other embodiment except for the use of an arcuate flat spring 40″ instead of the arcuate coil spring 40 and the different mounting required. Wherever possible, the parts are identified by the same reference numerals as before, but distinguished by double primes.

As shown in FIG. 8, the arcuate flat spring 40″ is mounted in the same position as the arcuate coil spring 40. the bottom end 46″ of the arcuate flat spring 40″ is connected to a plate 50″ by a bar 98 that is screwed on the plate 50″. A slot 100 in the top end 38″ of the arcuate flat spring 40″ fits over a depending hook 102 on the front end 34″ of the interposer 32″, and a tail 104 on the front end 34″ of the interposer 32″ helps retain the arcuate flat spring 40″ on the depending hook 102. The operation is the same as that using the arcuate coil spring 40.

Although the invention has been described in its preferred form with a certain degree of particularity, it is understood that the present disclosure of the preferred form has been made by way of example and that numerous changes in the details of construction and the combination and arrangement of parts can be resorted to without departing from the spirit and the scope of the invention as hereinafter claimed.

Having thus set forth the nature of the invention, what is claimed is:

1. In a typing machine of the kind having means for actuating a typing machine operation, a power roll rotatably mounted in the typing machine for engagement by the actuating means to actuate the typing machine operation, a key lever movably mounted in the typing machine, an interposer, means for supporting the interposer, means for releasing the interposer relative to the supporting means upon depression of the key lever, and means for restoring the key lever to a rest position, in combination, the improvement comprising:

a. means, connected between the interposer and a stationary portion of the typing machine, for biasing the interposer against the supporting means and after activation of the releasing means, against the actuating means to cause the actuating means to engage the power roll to actuate the typing machine operation; and b. means for restoring potential energy in the biasing means during return of the key lever to the rest position by the restoring means.

2. The typing machine of claim 1, in which the restoring means includes a nose on the key lever, the nose engaging the interposer.

3. The typing machine of claim 1, in which the key lever is a first key lever, the interposer is a first interposer, and the restoring means is a first restoring means; the typing machine has a second key lever, a second interposer, and a second restoring means; the first restoring means contacts the first interposer at a first location; and the second restoring means contacts the second interposer at a second location different from the first location to compensate for differences in length between the first and second key levers.

4. The typing machine of claim 1, in which the biasing means includes an arcuate spring, arcuate in the sense that the spring is arcuately supported.

5. The typing machine of claim 4, in which the releasing means bears against an intermediate portion of the arcuate spring to release the interposer.

6. The typing machine of claim 4, in which the arcuate spring is an arcuate flat spring.

7. The typing machine of claim 4, in which the arcuate spring is an arcuate coil spring.

8. The typing machine of claim 7, in which the stationary portion of the typing machine includes a spike, the typing machine further comprising:

c. a prong on the interposer, the arcuate coil spring impaled on the prong and on the spike.

9. The typing machine of claim 8, further comprising:

d. a hook on the arcuate coil spring; and e. means on the interposer for engaging the hook.

10. The typing machine of claim 9, in which the engaging means includes a knuckle and the hook is hooked over the knuckle.

11. the typing machine of claim 8, further comprising:

d. means for contacting the arcuate coil spring to help hold the arcuate coil spring on the spike.

12. The typing machine of claim 11, in which the contacting means includes a lip on the stationary portion of the typing machine.

* * * * *